US008961208B2

(12) United States Patent
Bentler et al.

(10) Patent No.: US 8,961,208 B2
(45) Date of Patent: Feb. 24, 2015

(54) ELECTRICAL WALL BUSHING TERMINAL

(75) Inventors: Harry Bentler, Lügde (DE); Thorsten Diessel, Hiddenhausen (DE); Torsten Schloo, Detmold (DE)

(73) Assignee: Phoenix Contact GmbH & Co., KG, Blomberg (DE)

( * ) Notice: Subject to any disclaimer, the term of this patent is extended or adjusted under 35 U.S.C. 154(b) by 179 days.

(21) Appl. No.: 13/817,693

(22) PCT Filed: Aug. 18, 2011

(86) PCT No.: PCT/EP2011/004152

§ 371 (c)(1), (2), (4) Date: Apr. 29, 2013

(87) PCT Pub. No.: WO2012/022483

PCT Pub. Date: Feb. 23, 2012

(65) Prior Publication Data

US 2013/0217276 A1 Aug. 22, 2013

(30) Foreign Application Priority Data

Aug. 19, 2010 (DE) ..... 10 2010 034 863

(51) Int. Cl.

| | |
|---|---|
| ***H01R 29/00*** | (2006.01) |
| ***H01R 9/26*** | (2006.01) |
| *H01R 9/24* | (2006.01) |
| *H01R 13/703* | (2006.01) |

(52) U.S. Cl.

CPC ..... *H01R 9/26* (2013.01); *H01R 9/2666* (2013.01); *H01R 9/2491* (2013.01); *H01R 13/7031* (2013.01)

USPC ..... 439/188; 439/709; 439/716

(58) Field of Classification Search

USPC ..... 439/709, 716, 188, 189

See application file for complete search history.

(56) References Cited

U.S. PATENT DOCUMENTS

| | | | | |
|---|---|---|---|---|
| 7,666,037 | B2 * | 2/2010 | Diessel | 439/857 |
| 8,460,038 | B2 * | 6/2013 | Eisert et al. | 439/716 |
| 2008/0261426 | A1 * | 10/2008 | Diekmann et al. | 439/189 |
| 2009/0061669 | A1 * | 3/2009 | Diekmann | 439/188 |
| 2011/0059658 | A1 * | 3/2011 | Eisert et al. | 439/716 |

* cited by examiner

*Primary Examiner* — Gary Paumen

(74) *Attorney, Agent, or Firm* — Greer, Burns & Crain, Ltd.

(57) ABSTRACT

An electric through-wall terminal having a housing and a contact device, at which a plug zone is provided for accommodating a test- and/or connection plug. A first conductor terminal is provided which is connected with a first contact unit of the contact device. A second conductor terminal is connected with a second contact unit of the contact device. The housing comprises plug-in apertures on two sides from each of which a test- and/or connection plug can be inserted into the plug zone for contacting the first and second contact units.

9 Claims, 3 Drawing Sheets

ELECTRICAL WALL BUSHING TERMINAL

BACKGROUND

The present invention relates to an electric through-wall terminal having a housing and a contact device provided with at least one plug zone for accommodating a test- and/or connection plug. A test plug or else a connection plug or else a test- and connection plug may be inserted into the plug zone. It is also possible for the test- and/or connection plug to act as a short-circuiting plug.

In the prior art a great variety of through-wall terminals have become known comprising a plug zone for accommodating a test- and/or connection plug.

These through-wall terminals tend to be configured as series terminals or test terminal blocks, comprising conductor terminal elements and associated power bars wherein the conductor terminal elements are in contact with one another in a contact area, unless a test plug had been inserted.

These through-wall terminals with connecting and disconnecting options are often employed in circuitry, measuring and control technology. The connecting and disconnecting option at the electric series terminal allows to realize different functions and different test options by way of inserting different plugs or connection plugs. The plugs used may, other than simple connection plugs or through connections, in particular be test plugs. These test plugs may comprise special components which allow testing the proper function of the power circuit connected with the through-wall terminal. Optionally, different test plugs allow to simultaneously or sequentially test different functions.

In the case of through-wall terminals configured as disk-shaped, electric series terminals, they may be plugged together with other electric terminals to form a series terminal block. Then a number of test plugs corresponding to the number of the series terminals can be plugged into such a series terminal block. It is possible to form a test plug block to be plugged into the series terminal block as a whole.

In DE 10 2006 052 894 A1, a test terminal block made of electric series terminals has become known comprising a plug-in zone in every series terminal for inserting a test plug. This known series terminal is provided with a pair of contact areas formed of contact legs in the plug zone for accommodating the contact plug wherein in the normal state the contact legs are in contact with one another in the first contact area, while the contact legs are spaced apart in the second contact area. When inserting a test plug the connection plug contacts the second contact area first. When inserting a test plug it first contacts the second contact area, establishing a test connection. Only inserting further makes the test plug contact the first contact area, urging apart the contact legs which are in resilient contact with one another.

Such a configuration ensures that in such a series terminal the test plug first safely establishes contact with the second contact area prior to disconnecting the electric connection at the first contact area. The known prior art operates reliably.

Testing or maintenance work in switch cabinets or electric system housings often does not require to open the switch cabinet to perform tests. In many cases it is sufficient for example for a through-wall terminal, being a terminal having a plug-in zone for a test plug at the switch cabinet, to be accessible from the exterior, to readily test the state of the electric circuit by inserting a test plug. In these cases it is very advantageous for such a through-wall terminal to be attached accessible on the outside surface of the switch cabinet. The drawback of this is though that in other, more extensive or basic test- and/or maintenance work the through-wall terminal provided with a plug zone for a test plug is disposed on the outside of the switch cabinet housing even when the switch cabinet is open. This results in increased maintenance efforts if the switch cabinet door must be opened since the maintenance worker must then always plug in the test plug from the outside of the switch cabinet although he may have to perform a great deal of maintenance in the interior of the switch cabinet.

SUMMARY

It is therefore the object of the present invention to provide a through-wall terminal having a plug zone for a test- and/or connection plug which operates reliably and allows reduced efforts when performing maintenance work.

The electric through-wall terminal according to the invention comprises a housing and a contact device which is provided with at least one plug zone for accommodating a test- and/or connection plug. The electric through-wall terminal according to the invention comprises a first conductor terminal connected with a first contact unit of the contact device. Furthermore at least one second conductor terminal is provided which is connected with a second contact unit of the contact device. The housing comprises at least at two sides, plug-in apertures through which at least one test- and/or connection plug can be inserted into the at least one plug zone for contacting the first and second contact units.

The electric through-wall terminal according to the invention has many advantages, among others since the electric through-wall terminal housing comprises plug-in apertures at least from two sides where at least one test- and/or connection plug each can be inserted for testing the circuit connected with the electric through-wall terminal and/or disconnecting the electric circuit.

The electric through-wall terminal according to the invention allows carrying out maintenance of an electric circuit wherein the test- and/or connection plug can be inserted into the electric terminal housing from two sides. To this end for example the electric terminal can be inserted in the housing wall so as to allow to selectively insert the test- and/or connection plug into the switch cabinet wall from the interior of the switch cabinet or from the exterior.

The electric through-wall terminal offers the option to insert a test- and/or connection plug into the electric terminal from at least two sides wherein both the first and second contact units of the contact device of the electric terminal can be contacted. This configuration according to the invention provides a flexible terminal which is uncomplicated in use and virtually replaces the functions of two test terminals while requiring as much space as does one single prior art series terminal.

In a preferred more specific embodiment the plug-in apertures are provided at opposite sides of the housing. This configuration allows insertion into the wall of a switch cabinet or into the door of a switch cabinet wherein then, one plug zone of the electric terminal is accessible from the outside and the plug zone or another plug zone is accessible from the inside. When carrying out maintenance work at switch cabinets this allows both to insert a test- and/or connection plug from the outside with the cabinet door closed, or else from the inside with the cabinet door open. This considerably facilitates the carrying out of test- and maintenance work and can decisively contribute to avoiding errors in maintenance work. The risk of industrial accidents also decreases since the cables to the test- and/or connection plugs do not have to run around an opened cabinet door or the like.

After acceptance and start-up of a system e.g. in scheduled maintenance, a connection and/or test plug can comfortably be inserted from the outside into the plug zone at the closed switch cabinet wall and the state of the system can be tested. In start-up or for more extensive maintenance work though, if the switch cabinet must be opened anyway or while it is still open, the connection and/or test plug can be inserted directly into the plug zone from the inside. Complicated closing of the switch cabinet door prior to plugging the connection and/or test plug into the plug zone may be omitted. In this way the invention offers considerable advantages both in start-up and in later maintenance work.

For plugging in from the inside the polarity of the connection and/or test plug is in particular mirrored compared to application from the outside. Because of this the connection and/or test plug must be wired with the measuring and test devices mirrored in respect of the test application by means of connected measuring lines.

It is possible to employ a specific connection and/or test plug for plugging in from the inside and to employ a differently wired connection and/or test plug for plugging in from the outside.

Or else it is possible for electronics to be installed in the connection and/or test plug to automatically identify and adjust the plug-in direction so as to allow the use of identical connection and/or test plugs from the outside and the inside. It is also possible to provide the connection and/or test plug with a switch for manually or automatically switching the wiring for plugging in from the inside or the outside.

The same applies to other distribution boxes, terminal boxes or the like. After opening, a connection and/or test plug can be plugged in from the inside, while with the distribution box closed, the connection and/or test plug can be inserted from the outside.

Preferably the first contact unit is connected with the first conductor terminal via a first power bar. Furthermore the second contact unit is preferably connected with the second conductor terminal via a second power bar. It is also possible to provide a third, fourth, or fifth conductor terminal at an electric through-wall terminal. It is also possible to provide multiple terminals in the shape of series terminals forming a series terminal block, as a through-wall terminal in the aggregate, each of which being provided with two, three or more conductor terminals. In the case of series terminals an additional plugging option for at least one cross-jumper may be provided for setting two or more conductor terminals at the same potential.

In a preferred specific embodiment at least one contact unit comprises a pair of spaced apart first and second contact portions. This configuration is very advantageous since it allows to ensure that in the case of making contact by a test- and/or connection plug, contact with the inserted plug is first established at the first (or second) contact portion, while the connection between the first and second conductor terminals is separated only thereafter, at the second (or first) contact portion. This ensures a safe and reliable operation in particular in delicate electric systems and/or with high voltages applied and/or with high acting current strengths.

It is particularly preferred for the first and second contact units at the first and second contact portions to be in electrically conducting contact in the normal state. A normal state is presently understood to mean the state in which no test- and/or connection plug is inserted in the corresponding plug zone. This means that in the normal state the pair of contact units are connected with one another in two contact portions remote from one another to be electrically conducting. Independently from one another the two contact portions provide a reliable electrical connection of the first and second contact units and thus of the first conductor terminal with the second conductor terminal.

This specific embodiment is particularly advantageous because the inserting direction of a test- and/or connection plug is thus independent from the sequence of the first and second contact portions. When the test- and/or connection plug is inserted from the side of the first contact portion and when it is for example first inserted into the first contact unit, then the electrically conducting contact at the second contact portion is maintained for the time being even after disconnecting the contact at the first contact portion. Only when the connection and/or test plug is completely or nearly completely inserted will the electrically conducting contact at the second contact portion be disconnected. However, at the time of disconnecting at the second contact portion, the connection and/or test plug is already reliably in contact with the first contact portion. In the case of inserting from the other side this correspondingly applies in reverse where in normal state the first contact unit and the second contact unit are in electrically conducting contact at the first and second contact portions.

Preferably at least one contact unit consists of a resilient material at least in part. Particularly preferably both contact units consist at least in part and in particular substantially or entirely of one or more resilient materials. Or else it is possible for only one contact unit to partially consist of a resilient material since the spring action of this contact unit allows reliable electric contact with the other of the contact units.

In preferred configurations at least one contact unit comprises at least one contact leg. Such a contact leg may in particular be configured as an elongated loop. Due to the length of the loop being larger than its width, an elongated loop ensues. The length of the elongated loop is in particular at least 1.5 times and preferably at least twice as large as a width extending transverse thereto.

Such a loop may be configured as a closed or an open loop. What is possible and preferred is for example an approximately U- or C-shaped configuration wherein the first and second contact portions are provided in the two end regions of the "C". A C-shaped configuration provides spaced apart portions allowing spatial separation of the first and second contact portions. The spatial separation allows a separation of the contact portions following from one another in terms of time and space, in particular in any desired sequence in dependence on the inserting direction.

Particularly preferably the electric through-wall terminal is configured as an electric series terminal. In the through-wall terminal, a connection and/or test plug and/or a short-circuiting plug can be inserted from two or more sides through the wall of a terminal cabinet for example into the terminal housing.

BRIEF DESCRIPTION OF THE DRAWINGS

Further advantages and features of the present invention can be taken from the exemplary embodiment which will be described below with reference to the enclosed figures.

These show in.

DETAILED DESCRIPTION

With reference to the accompanying FIGS. 1 to 6 an exemplary embodiment of the electric through-wall terminal 1 according to the invention will be discussed hereinafter, which is presently configured as an electric series terminal 30 and in particular as a through-wall terminal block 40.

Figure 1:
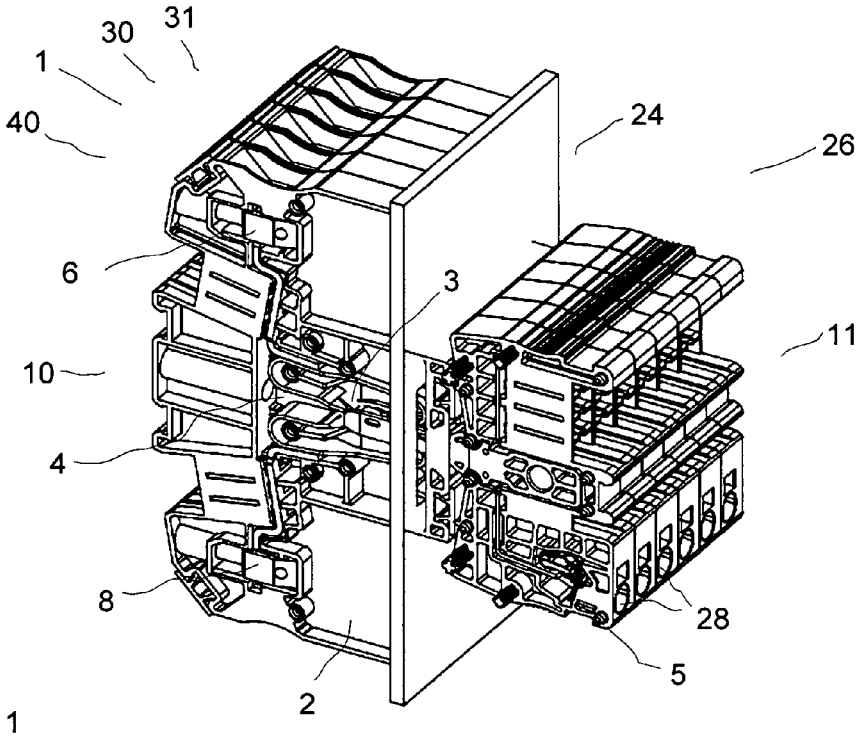
FIG. 1 a perspective view of a through-wall terminal according to the invention with a test plug inserted.

The electric through-wall terminal 1 illustrated in FIG. 1 in a perspective view is presently illustrated with an inserted test- and/or connection plug 5 which may be configured as a short-circuiting plug.

The electric through-wall terminal 1 comprises a housing 2 consisting of an insulating material and offering the required protection and a shock protection for the conductor terminals.

In FIG. 1 a through-wall terminal block having a series terminal block 31 is shown provided with multiple series terminals 30. Each of the terminals 1 of the series terminal block 31 is presently provided with a first conductor terminal 6 and a second conductor terminal 8, which in the normal state 14 are connected with one another via the contact device 3 to be electrically conducting.

In the first plug-in state 26 illustrated in FIG. 1 the first conductor terminal 6 is electrically disconnected from the second conductor terminal 8 since the test- and/or connection plug 5 is plugged into the plug zone 4. Depending on the configuration of the test- and/or connection plug 5 it is possible to also establish an electrically conducting connection in the first plug-in state 26 illustrated in FIG. 1 via the test- and/or connection plug 5 between the first conductor terminal 6 and the second conductor terminal 8. At any rate, the direct, electrically conducting connection at the contact device 3 is disconnected by way of inserting the test- and/or connection plug 5.

The test- and/or connection plug 5 may be provided with test terminals the quantity of which per test- and/or connection plug 5 may vary according to the requirements at the time.

The electric through-wall terminal 1 is mounted at a wall 24 for example of a switch cabinet. This allows to insert a test- and/or connection plug 5 into the plug zone 4 both from the side 10 and from the side 11 of the housing 2 of the through-wall terminal 1.

In the illustrated exemplary embodiment the through-wall terminal 1 virtually comprises a shared plug-in zone 4 which is equally effective for plugging in the test- and/or connection plug 5 from both sides 10 and 11. Or else the plug-in apertures 12 and 13 may be regarded as separate plug-in zones which for the sake of simplicity are presently both shown at reference numeral 4.

The first conductor terminal 6 and the second conductor terminal 8 and the plug-in aperture 12 are preferably accessible from one side of the wall 24 and in particular from one side 10 of the housing, while the plug-in aperture 13 is accessible from the other side 11. Preferably the conductor terminals 6 and 8 and the plug-in aperture 12 are accessible approximately from a direction oriented opposite the plug-in aperture 13.

The plug zone 4 is accessible from both sides of the housing while the conductor terminals 6 and 8 are accessible from one side only.

Figure 2:
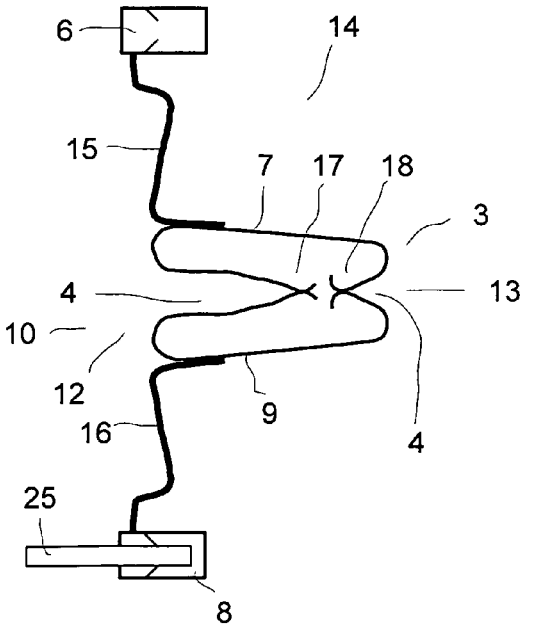
FIG. 2 a simplistic cross-section of a through-wall terminal.

FIG. 2 illustrates in an enlarged, simplistic cross-section an electric through-wall terminal 1 where a conductor 25 is inserted into the second conductor terminal 8 only. In normal operation a respective conductor 25 will be inserted into the first conductor terminal 6 also.

The first conductor terminal 6 is connected with the first contact unit 7 of the contact device 3 through a power bar 15 while the second conductor terminal 8 is connected with the second contact unit 9 via a power bar 16. It is also possible for one power bar or both power bars to be integral components of the respective contact unit.

Figure 3:
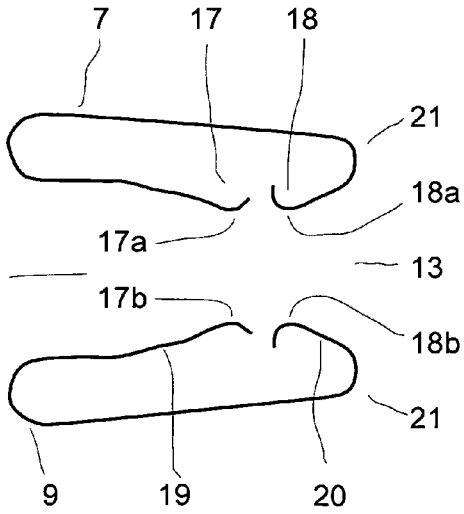
FIG. 3 the contact unit of the through-wall terminal according to FIG. 2.

FIG. 3 illustrates the first contact unit 7 and the second contact unit 9 in an exploded view with the distance between the two contact units 7 and 9 enlarged such that the contact legs 19 and 20 of the first contact unit 7 and the second contact unit 9 are no longer in contact but are illustrated spaced apart from one another. Furthermore the two contact units 7 and 9 are illustrated enlarged for better explaining their function.

When mounted the contact units 7 and 9 are disposed as illustrated in FIG. 2 and the contact legs 19 are in contact at the first contact portion 17 and the contact legs 20 are in contact at the second contact portion 18. Contact is present at the first contact portion 17, of the contact point 17*a* of the contact unit 7 with the contact point 17*b*. At the second contact portion 18 spaced apart thereof, the contact point 18*a* of the contact unit 7 contacts the contact point 18*b*, so as to provide a redundant, electrically conducting connection.

Both the first contact unit 7 and the second contact unit 9 are presently configured as a loop 21, showing an elongated, approximately C-shaped shape the length of which is presently more than twice the width. At the ends of the "C" the contact portions 17 and 18 are provided which are axially spaced apart viewed in the two plug-in directions. Both the contact units 7 and 9 may be configured identically and arranged mirror-symmetrically.

The first contact portion 17 may be designated as rear or inner, and the second contact portion 17 as front or outer, contact portion if the side 10 is disposed inside a switch cabinet or distribution box and the side 11 is directed outwardly.

In the normal state 14 illustrated in FIG. 2, in which no test- and/or connection plug 5 is inserted into the plug zone 4, the first and second contact units 7 and 9 are in contact at the two contact portions 17 and 18. This results in that when a test- and/or connection plug 5 is inserted into the first plug-in aperture 12 or the second plug-in aperture 13 both from the first side 10 or from the second side 11, a contact portion 17 or 18 will be contacted first. Thereafter the electric contact is disconnected at this contact portion while at the other of the contact portions the electrically conducting contact is still maintained until the test- and/or connection plug has been pushed in far enough for the contact to be disconnected also at the first or second contact portion 17 or 18 respectively. This function is independent of whether a test- and/or connection plug 5 is pushed into the first plug-in aperture 12 or the second plug-in aperture 13. When a test plug is inserted into the plug zone 4, the plug is first safely contacted and only thereafter will the direct electrical connection of the first conductor terminal 6 with the second conductor terminal 8 be disconnected.

It is also possible that more than two plug-in apertures 12 and 13 are provided where, when a test- and/or connection plug is inserted, a reliable contact with the test- and/or connection plug 5 is first established before contact with the other plug-in apertures is disconnected.

Figure 4:
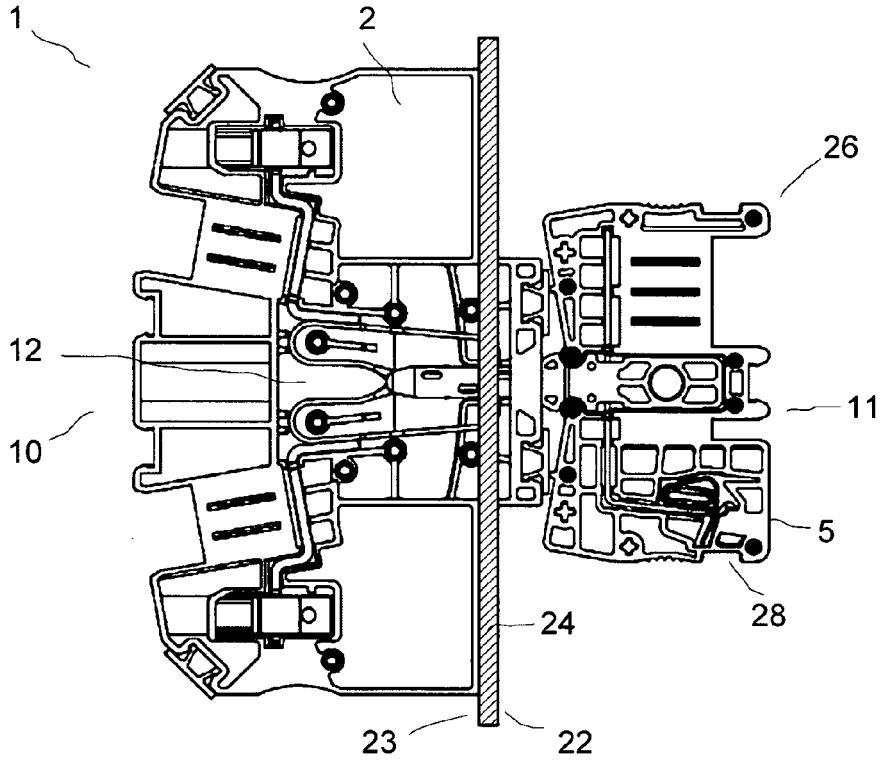
FIG. 4 the through-wall terminal according to FIG. 1 with a test plug plugged in from a first side.

FIG. 4 shows a cross-section of an electric through-wall terminal 1 mounted to a wall 24 for example of a terminal box, a distribution box, or a switch cabinet. The electric through-wall terminal is accessible from both sides 22 and 23 of the wall 24. Thus, a test- and/or connection plug 5 can be inserted into the plug-in apertures 12 and 13 from the first side 10 or from the second side 11, for carrying out tests or maintenance.

FIG. 4 illustrates the first plug-in state 26 where the test- and/or connection plug 5 has been inserted from the second side 11.

Figure 5:
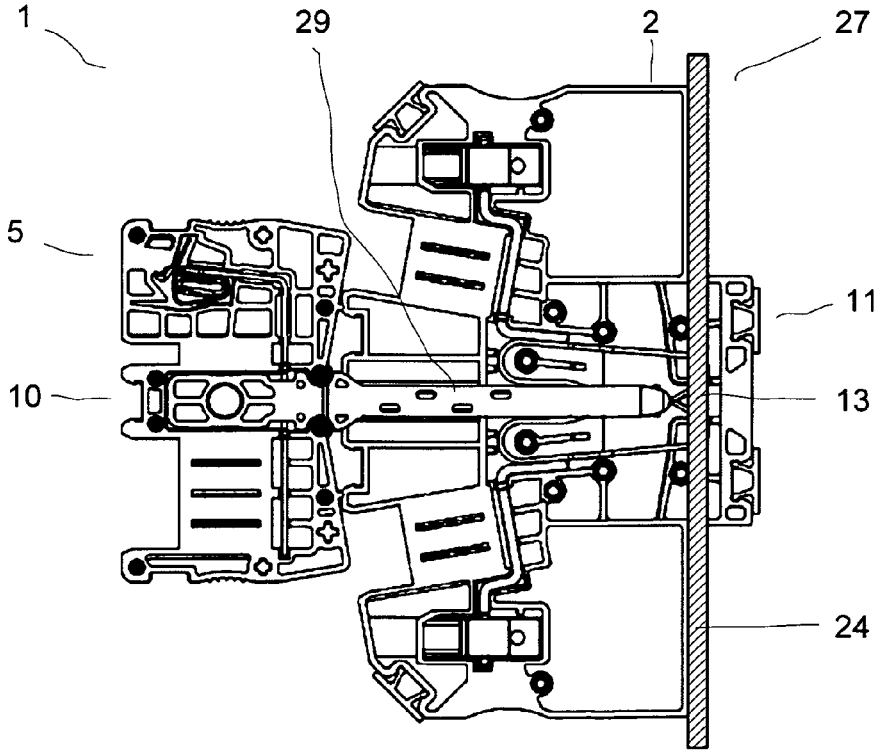
FIG. 5 the through-wall terminal according to FIG. 1 with a test plug plugged in from the other side.

FIG. 5 illustrates the second plug-in state 27 where the test- and/or connection plug 5 is plugged in from the first side 10. FIG. 5 shows the state in which the contact tip 29 of the test- and/or connection plug 5 contacts the first contact portion 17 of the contact device 3 before the electrically conducting connection is disconnected.

Figure 6:
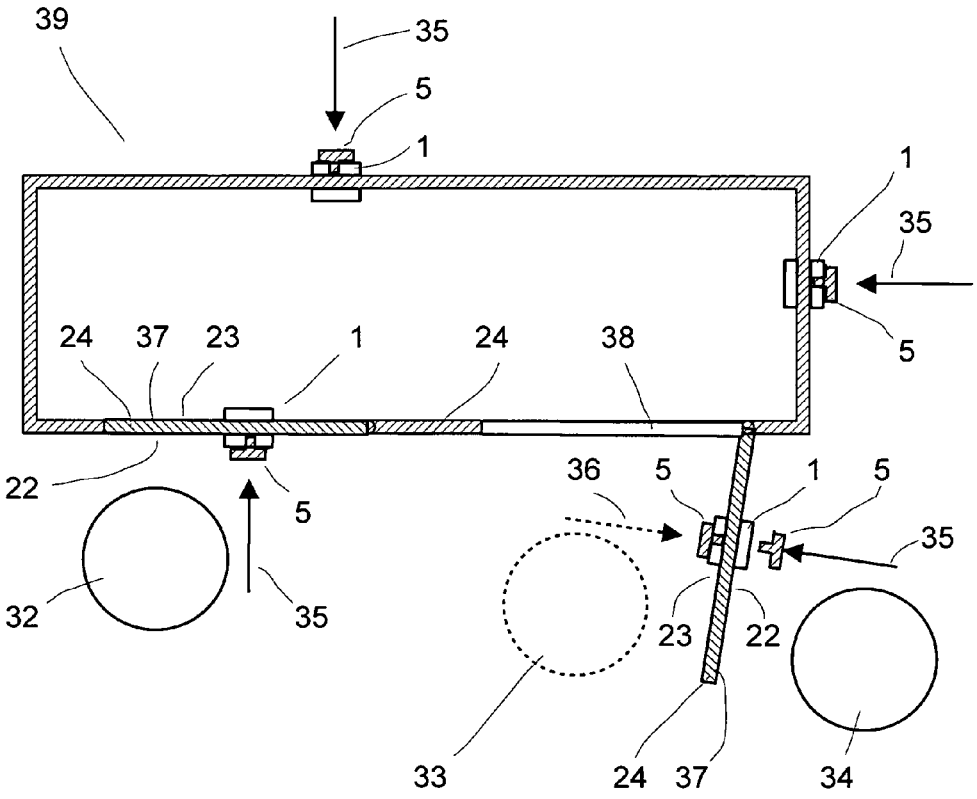
FIG. 6 a simplistic top view of a switch cabinet with through-wall terminals according to the invention.

FIG. 6 shows a simplistic top view of a sectional view of a distribution or terminal box. The hatched square section represents a switch cabinet 39. The switch cabinet 39 is provided with two doors 37 one of which is opened, such that the non-sectioned door opening can be recognized.

The doors 37 are part of the walls 24 surrounding the interior. Every door 37 is presently provided with a through-wall terminal 1. Moreover, through-wall terminals 1 are disposed in two other walls 24. When the switch cabinet is closed, test- and/or connection plugs 5 can be inserted into the plug zone 4 from the outside 22 in the direction of insertion 35 to test e.g. the state of the system and the terminals.

The persons 32 and 34 illustrated in solid lines can insert connection and/or test plugs directly from the outside into the through-wall terminal 1 concerned. They do not need to move from their position.

The person 33 does not need to move from his/her position and move to the position of person 34 for inserting the connection and/or test plug into the through-wall terminal 1. Person 33 shown as a dashed line can likewise directly insert from the inside the connection and/or test plug in the direction of insertion 36 in the through-wall terminal 1 at the opened door 37. This allows considerably more flexibility in handling.

While e.g. in assembly, start-up or comprehensive maintenance the door 37 is open and a test- and/or connection plug 5 configured as a connection and test plug can in particular be plugged into the through-wall terminal 1 from the inside, a person can when the cabinet door is closed plug in the connection and test plug from the outside without requiring opening the switch cabinet first.

On the whole the invention provides a through-wall terminal 1 with the option of connecting a test- and/or connection plug 5 wherein the test- and/or connection plug 5 can be inserted into the housing 2 of the electrical terminal 1 from at least two sides. This allows high security with easy operation.

The invention provides an electrical terminal which can in particular be employed as a series terminal 30 or as a through-wall terminal block 40. The terminal 1 may be installed in a switch cabinet wall and thus offers a test plug zone external of the cabinet e.g. for control measurements, and a test plug zone internal of the cabinet e.g. for start-up tests or wiring tests.

To allow mounting the through-wall terminal in a wall cutout of the switch cabinet wall, the housing is provided with additional installation or snap-in flanges to clampingly fix or screw the housing 2 to the wall 24 or attach it in some other way.

LIST OF REFERENCE NUMERALS electric through-wall terminal 1
housing 2
contact device 3
plug zone 4
test- and/or connection plug 5
first conductor terminal 6
first contact unit 7
second conductor terminal 8
second contact unit 9
side 10, 11
plug-in aperture 12, 13
normal state 14
power bar 15, 16
contact portions 17, 18
contact leg 19, 20
loop 21
wall side 22, 23
wall 24
conductor 25
first plug-in state 26
second plug-in state 27
test terminal 28
contact tip 29
series terminal 30
series terminal block 31
person 32-34
direction of insertion from outside 35
direction of insertion from inside 36
door 37
door opening 38
switch cabinet 39
through-wall terminal block 40

The invention claimed is:

1. An electric through-wall terminal, comprising: a housing and a contact device, at which at least one plug zone is provided for accommodating at least one test- and/or connection plug;

having a first conductor terminal connected with a first contact unit of the contact device;

and having a second conductor terminal connected with a second contact unit of the contact device; and the housing comprises plug-in apertures at least on two sides from each of which at least one test- and/or connection plug can be inserted into the plug zone for contacting the first and second contact units.

2. The through-wall terminal according to claim 1, wherein the plug-in apertures are provided at opposite sides of the housing.

3. The through-wall terminal according to claim 1, wherein the first contact unit is connected with the first conductor terminal via a first power bar and wherein the second contact unit is connected with the second conductor terminal via a second power bar.

4. The through-wall terminal according to claim 1, wherein at least one contact unit comprises a pair of spaced apart first and second contact portions.

5. The through-wall terminal according to claim 1 wherein in normal state the first and second contact units are in electrically conducting contact at the first and second contact portions.

6. The through-wall terminal according to claim 1 wherein at least one contact unit consists of a resilient material at least in part.

7. The through-wall terminal according to claim 1 wherein at least one contact unit comprises at least one contact leg that is in particular formed as an elongated loop.

8. The through-wall terminal according to claim 1 which is configured as a series terminal.

9. The through-wall terminal according to claim 1 which is configured as a through-wall terminal and can be operated from both sides of the wall and a connection and/or test plug can be inserted.

* * * * *